US009070988B2

(12) United States Patent
Sato

(10) Patent No.: US 9,070,988 B2
(45) Date of Patent: Jun. 30, 2015

(54) STRUCTURE AND METHOD FOR CONNECTION OF CONNECTOR TERMINAL

(71) Applicant: YAZAKI CORPORATION, Minato-ku, Tokyo (JP)

(72) Inventor: Kei Sato, Makinohara (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 14/263,432

(22) Filed: Apr. 28, 2014

(65) Prior Publication Data

US 2014/0235117 A1 Aug. 21, 2014

Related U.S. Application Data

(63) Continuation of application No. PCT/JP2012/079718, filed on Nov. 9, 2012.

(30) Foreign Application Priority Data

Nov. 11, 2011 (JP) ..... 2011-247620

(51) Int. Cl.
*H01R 4/18* (2006.01)
*H01R 43/048* (2006.01)
*H01R 43/05* (2006.01)

(52) U.S. Cl.
CPC ..... *H01R 4/18* (2013.01); *Y10T 29/49185* (2015.01); *H01R 4/184* (2013.01); *H01R 43/05* (2013.01); *H01R 43/048* (2013.01)

(58) Field of Classification Search
CPC ..... H01R 4/20; H01R 4/203; H01R 4/206; H01R 4/184; H01R 4/185; H01R 43/05
See application file for complete search history.

(56) References Cited

U.S. PATENT DOCUMENTS

2011/0065316 A1 3/2011 Morikawa (Continued)

FOREIGN PATENT DOCUMENTS

| | | | |
|---|---|---|---|
| JP | 2001-162647 | A | 6/2001 |
| JP | 2008-235130 | A | 10/2008 |
| WO | 2011/115004 | A1 | 9/2011 |

OTHER PUBLICATIONS

Communication dated Mar. 30, 2015 issued by the Korean Intellectual Property Office in counterpart Korean Patent Application No. 10-2014-7011128.

(Continued)

*Primary Examiner* — Ross Gushi
(74) *Attorney, Agent, or Firm* — Sughrue Mion, PLLC

(57) ABSTRACT

In a structure of connection of a connector terminal 10 connected to an electric wire whose core wire is covered with a outer cover, the connector terminal has a barrel portion for crimping the end of the electric wire and an electric connection portion electrically connected to a mating terminal. The outer cover of the electric wire is cut and separated in the vicinity of the end portion of the electric wire and displaced to expose the core wire. The separated portion of the outer cover displaced toward the end portion of the electric wire, an exposed portion of the core wire, and a portion of the electric wire covered with the outer cover are crimped to the barrel portion of the connector terminal.

2 Claims, 4 Drawing Sheets

(56) References Cited

U.S. PATENT DOCUMENTS

| | | | | |
|---|---|---|---|---|
| 2013/0126234 | A1* | 5/2013 | Ono et al. | 174/75 R |
| 2013/0319761 | A1* | 12/2013 | Furukawa | 174/74 R |
| 2014/0106628 | A1* | 4/2014 | Sato | 439/877 |
| 2014/0151083 | A1* | 6/2014 | Ohnuma et al. | 174/93 |
| 2014/0154915 | A1* | 6/2014 | Ohnuma et al. | 439/587 |
| 2014/0235117 | A1* | 8/2014 | Sato | 439/877 |
| 2015/0004826 | A1* | 1/2015 | Starke | 439/345 |
| 2015/0047899 | A1* | 2/2015 | Farole et al. | 174/75 R |

OTHER PUBLICATIONS

International Search Report (PCT/ISA/210) dated Mar. 6, 2013 issued by the International Searching Authority in International Application No. PCT/JP2012/079718.

Written Opinion (PCT/ISA/237) dated Mar. 6, 2013 issued by the International Searching Authority in International Application No. PCT/JP2012/079718.

* cited by examiner

STRUCTURE AND METHOD FOR CONNECTION OF CONNECTOR TERMINAL

CROSS REFERENCE TO RELATED APPLICATIONS

This application is a continuation of PCT application No. PCT/JP2012/079718, which was filed on Nov. 9, 2012 based on Japanese Patent Application (No. P2011-247620) filed on Nov. 11, 2011, the contents of which are incorporated herein by reference.

BACKGROUND OF THE INVENTION

1. Field of the Invention

An exemplary embodiment of the present invention relates to a structure and method for connecting a connector terminal to an electric wire.

2. Description of the Related Art

In order to protect a connection portion of a connector terminal that is to be connected to a terminal of an electric wire, a hitherto known technique is to secure, within a molding die assembly including an upper die and a lower die, a hollow molding region into which a terminal connection portion made by crimping terminal hardware to a forefront conductor of a coated electric wire is to be set and accommodated. A molten molding resin is injected into the molding region, thereby coating and molding the terminal connection portion (see; for instance, JP-A-2001-162647).

SUMMARY OF THE INVENTION

As mentioned above, after being subjected to processing pertaining to a crimping step in which an electric wire is crimped, the connector terminal whose crimped connection portion has been molded is taken out of a crimper and delivered to a molding machine. The molding machine performs processing pertaining to a molding step in which a resin mold is formed by injecting the molding resin. Therefore, the molding machine for performing processing pertaining to the molding step and a resin material for molding purpose are necessary, which adds to costs of facilities and manufacturing costs.

The exemplary embodiment of the present invention has been conceived in light of the circumstance and aims at providing a structure and method for connection of a connector terminal that can be connected to an electric wire without fail and exhibit a superior anticorrosion property at a connection portion where the connector terminal is connected to a conductor while saving costs of facilities and manufacturing costs is achieved.

To accomplish the object, the exemplary embodiment of the present invention provides with a structure for connection (1).

(1) A structure for connection, including an electric wire whose conductor is covered with an outer cover, and a connector terminal connected to the electric wire, wherein the connector terminal has a barrel portion for crimping an end portion of the electric wire and an electric connection portion to be electrically connected to a mating terminal, the outer cover is cut and separated in a vicinity of the end portion of the electric wire, and a separated portion of the outer cover is displaced toward the end portion so as to expose the conductor, and the separated portion of the outer cover displaced toward the end portion of the electric wire, the exposed portion of the conductor, and a portion of the electric wire covered with the outer cover are crimped to the barrel portion of the connector terminal in a state that the exposed portion and its neighborhood of the conductor are completely sealed.

In the structure for connection described in connection with (1), the separated portion of the outer cover displaced toward the end portion of the electric wire, the exposed portion of the conductor, and the portion of the electric wire covered with the outer cover are crimped to the barrel portion of the connector terminal. Therefore, the exposed portion and its neighborhood of the conductor in the electric wire crimped to the connector terminal are completely sealed, thereby rendering the conductor waterproof. Consequently, even when dissimilar metals are connected to each other, occurrence of electrical corrosion, such as bimetallic corrosion, in a connection portion can be prevented without molding the connection portion in resin by a molding machine. Specifically, the connector terminal can be reliably connected to the electric wire by means of only the crimper, and a superior anticorrosion property can be yielded at the area where the connector terminal is connected to the conductor while saving costs of facilities and manufacturing costs is achieved by obviating a necessity for the molding machine and the molding resin. Expanding wire harness to a manufacturing plant can be practiced with advantage.

To accomplish the object, the exemplary embodiment of the present invention provides with the method for connection (2).

(2) A method for connecting a connector terminal to an electric wire, in which the connector terminal has a barrel portion for crimping an end portion of the electric wire whose conductor is covered with an outer cover and an electric connection portion electrically connected to a mating terminal, the method including cutting and separating the outer cover in a vicinity of the end portion of the electric wire, displacing a separated portion of the outer cover toward the end portion so as to expose the conductor, and crimping the separated portion of the outer cover displaced toward the end portion of the electric wire, the exposed portion of the conductor, and a portion of the electric wire covered with the outer cover, to the barrel portion of the connector terminal in a state that the exposed portion and its neighborhood of the conductor are completely sealed.

Under the method for connection of a connector terminal described in connection with (2), the separated portion of the outer cover, which has been cut and separated in the neighborhood of the end portion, is displaced toward the end portion, thereby partially exposing the conductor. The separated portion of the outer cover, the exposed portion of the conductor, and the portion of the electric wire covered with the outer cover are crimped to the respective corresponding portions of the barrel portion of the connector terminal, thereby completely sealing the exposed portion and its neighborhood of the conductor of the electric wire and rendering the conductor waterproof. Consequently, even when dissimilar metals are connected to each other, occurrence of electrical corrosion, such as bimetallic corrosion, in a connection portion can be prevented without molding the connection portion in resin by means of the molding machine. Specifically, the connector terminal can be reliably connected to the electric wire by means of only the crimper, and a superior anticorrosion property can be yielded at the area where the connector terminal is connected to the conductor while saving costs of facilities and manufacturing costs is achieved by obviating a necessity for the molding machine and the molding resin. Expanding wire harness to a manufacturing plant can be practiced with advantage.

The exemplary embodiment of the present invention makes it possible to provide a structure and method for connection of a connector terminal that can be connected to an electric wire without fail and exhibit a superior anticorrosion property at a connection portion where the connector terminal is connected to a conductor while saving costs of facilities and manufacturing costs is achieved.

The exemplary embodiment of the present invention has been briefly described thus far. Details of the exemplary embodiment of the present invention will be clarified further by reading through the exemplary embodiment for implementing the present invention to be described below by reference to the accompanying drawings.

BRIEF DESCRIPTION OF THE DRAWINGS

FIGS. 5A and 5B are illustrations for explaining an electric wire pretreatment step, wherein FIG. 5A is a side elevation of an end portion of the electric wire and FIG. 5B is a side elevation of the end portion of the electric wire from which a outer cover is separated;

DETAILED DESCRIPTION OF THE EXEMPLARY EMBODIMENTS

An exemplary embodiment of the present invention is hereunder described by reference to the drawings.

Figure 1:
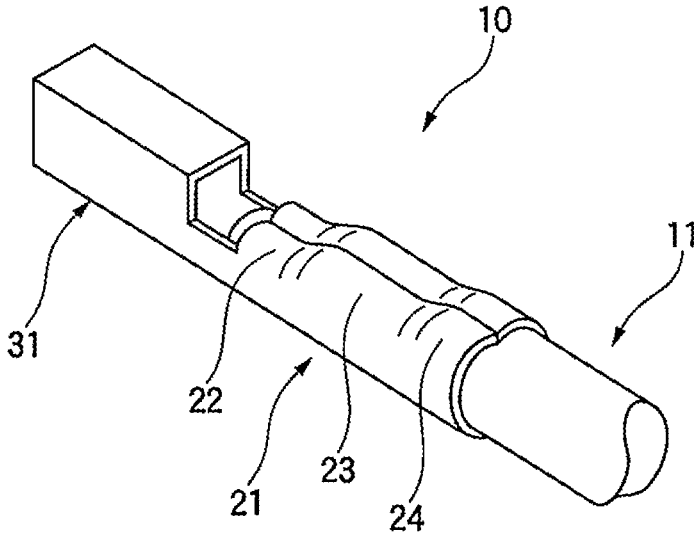
FIG. 1 is a perspective view of a connector terminal connected to an electric wire for explaining an embodiment of the present invention.
Figure 2:
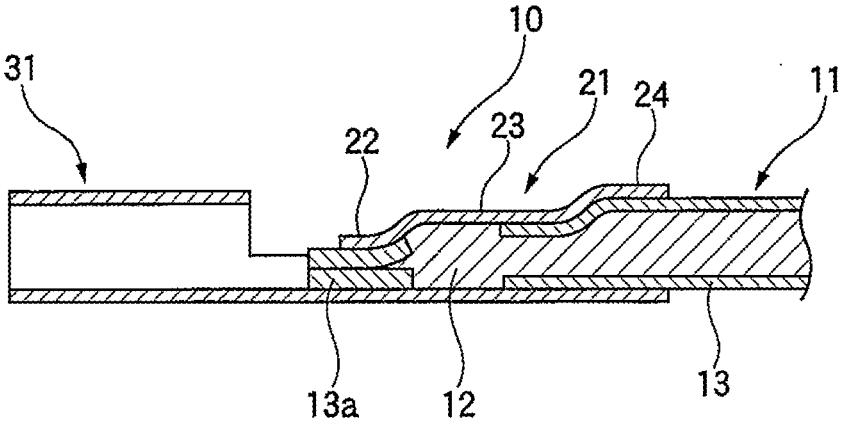
FIG. 2 is a cross section of the connector terminal connected to the electric wire for explaining the embodiment of the present invention.
Figure 3:
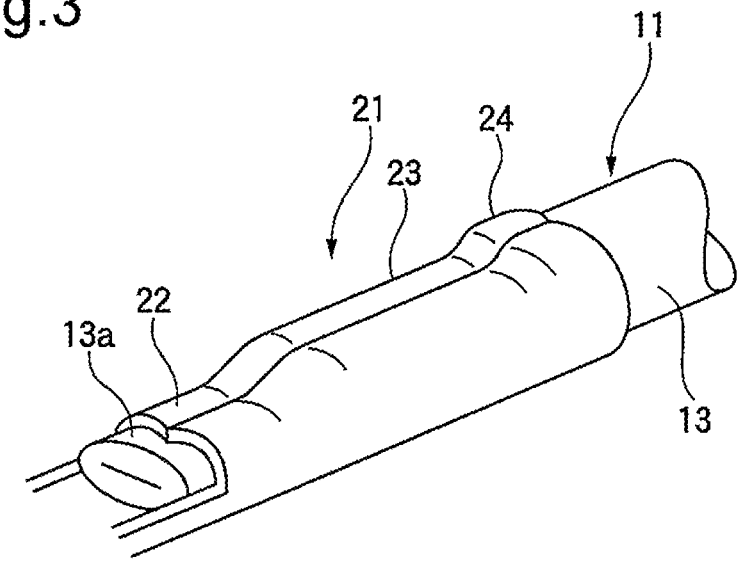
FIG. 3 is a perspective view of a barrel portion of the connector terminal connected to the electric wire for explaining the embodiment of the present invention.
Figure 4:
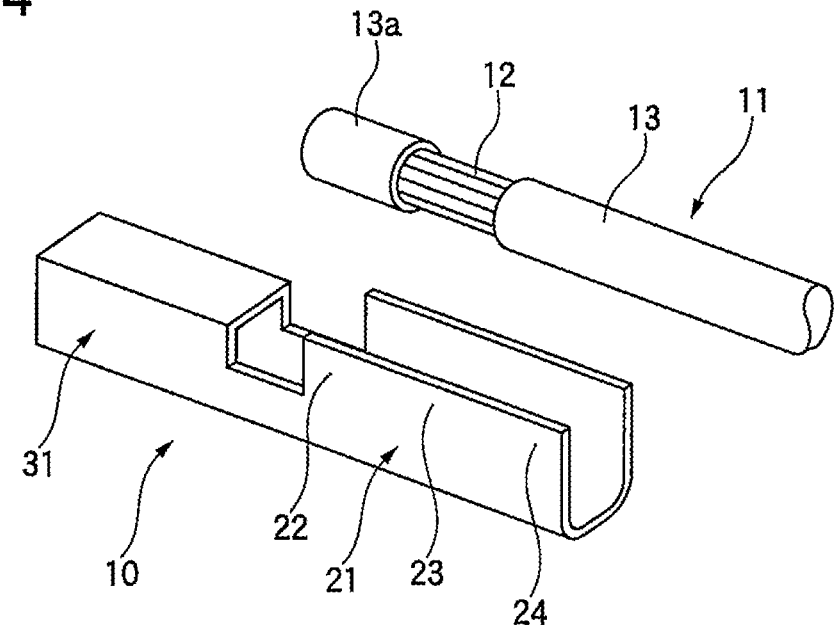
FIG. 4 is a perspective view of the connector terminal and the electric wire for explaining the embodiment of the present invention.
Figure 5A:
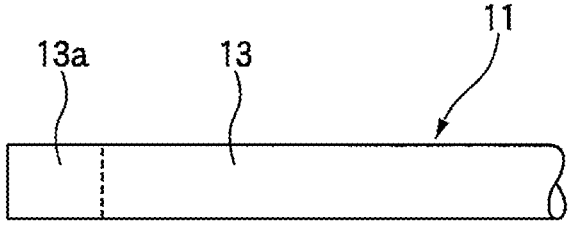
Figure 5B:
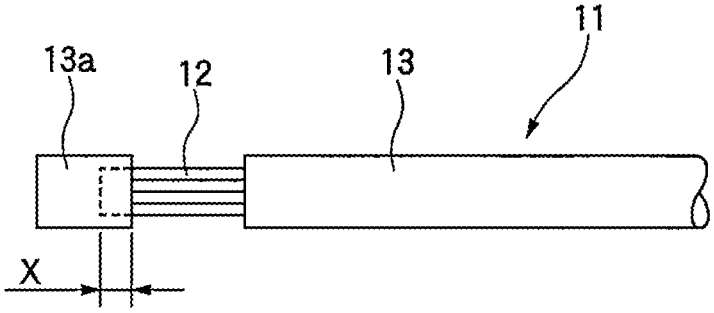
Figure 6:
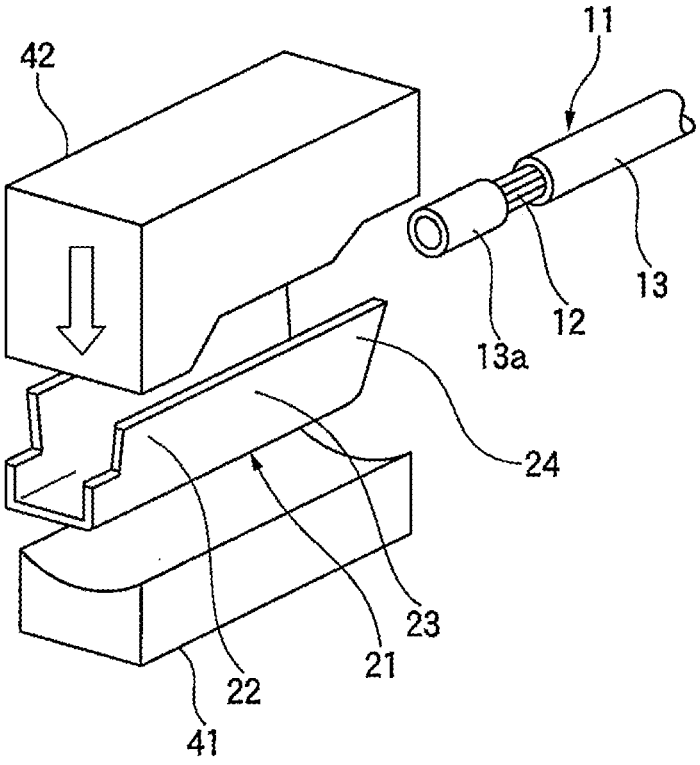
FIG. 6 is a perspective view of a crimper in which the connector terminal for explaining a crimping connection step is set.

FIG. 1 is a perspective view of a connector terminal connected to an electric wire for explaining an embodiment of the present invention; FIG. 2 is a cross section of the connector terminal connected to the electric wire for explaining the embodiment of the present invention; FIG. 3 is a perspective view of a barrel portion of the connector terminal connected to the electric wire for explaining the embodiment of the present invention; FIG. 4 is a perspective view of the connector terminal and the electric wire for explaining the embodiment of the present invention; FIGS. 5A and 5B are illustrations for explaining an electric wire pretreatment step, wherein FIG. 5A is a side elevation of an end portion of the electric wire and FIG. 5B is a side elevation of an end portion of the electric wire from which a outer cover is separated; and FIG. 6 is a perspective view of a crimper in which a connector terminal for explaining a crimping connection step is set.

As shown in FIGS. 1 through 3, a connector terminal 10 is connected to an electric wire 11. The connector terminal 10 is formed by; for instance, pressing, a conductive metallic material, such as copper or a copper alloy, and has a barrel portion 21 and an electric connection portion 31.

As shown in FIG. 4, the barrel portion 21 is segmented, in sequence from the electric connection portion 31, or a forefront side, to a rear end side, a forefront crimping portion 22, a core wire crimping portion 23, and an outer cover crimping portion 24. The barrel portion 21 is formed into the shape of the letter U or an indentation that is opened upward when viewed from the front. The barrel portion 21 is crimped while an end portion of the electric wire 11 is placed in the barrel portion 21.

The electric wire 11 to which the connector terminal 10 is connected has a core wire (conductor) 12 made of aluminum and an outer cover 13 that is extruded around the core wire 12 in a covering manner. The outer cover 13 is cut and separated in a neighborhood of an end portion of the electric wire 11. The electric wire 11 is crimped to the barrel portion 21 of the connector terminal 10 while the core wire 12 remains expose as a result of displacement of a thus-detached separated portion 13*a* of the outer cover 13 toward the end portion.

The electric wire 11 is thereby crimped in such a way that the separated portion 13*a* of the outer cover 13 displaced toward the end portion, the exposed portion of the core wire 12, and a portion of the electric wire covered with the outer cover 13 are crimped to the forefront crimping portion 22, the core wire crimping portion 23, and the outer cover crimping portion 24 that make up the barrel portion 21 of the connector terminal 10, respectively.

As mentioned above, in the structure for connection of the connector terminal of the embodiment, the separated portion 13*a* of the outer cover portion 13 displaced toward the end portion of the electric wire 11, the exposed portion of the core wire 12, and the portion of the electric wire covered with the outer cover 13 are crimped to the barrel portion 21 of the connector terminal 10. In the electric wire 11 crimped to the connector terminal 10, the exposed portion and its neighborhood of the core wire 12 are completely shielded, so that the core wire 12 can be made waterproof. Consequently, even when dissimilar metals are connected to each other, occurrence of electrical corrosion, such as bimetallic corrosion, in a connection portion can be prevented without molding the connection portion in resin by means of the molding machine. Specifically, the connector terminal can be reliably connected to the electric wire 11 by means of only a crimper, and a superior anticorrosion property can be yielded at the area where the connector terminal is connected to the core wire 12 while saving costs of facilities and manufacturing costs is achieved by obviating a necessity for the molding machine and the molding resin. Expanding wire harness to a manufacturing plant can be practiced with advantage.

A method for connecting the electric wire 11 to the connector terminal 10 is now described.

(Electric Wire Pretreatment Steps)

First, as shown in FIG. 5A, the outer cover 13 is cut and separated at a cut-separation position (designated by a broken line in the drawing) in a vicinity of the end portion of the electric wire 11. The separated portion 13*a* of the outer cover 13 separated on the forefront side of the electric wire by cutting and separation is displaced toward the end portion of the electric wire as shown in FIG. 5B, thereby making the core wire 12 expose.

The core wire 12 is partially covered with a portion of the separated portion 13*a* of the outer cover 13, and a coverage dimension X of the separated portion 13*a* of the outer cover 13 to the core wire 12 is set to one millimeter or more. Moreover, the separated and cut position of the outer cover 13 is set such that the core wire 12 becomes expose to such an extent that the core wire crimping portion 23 of the barrel portion 21 is sufficiently crimped while the separated portion 13*a* of the outer cover 13 covers the core wire 12 to the coverage dimension X.

(Crimping and Connection Step)

As shown in FIG. 6, the barrel portion 21 of the connector terminal 10 is interposed between a lower crimping die 41 and an upper crimping die 42 of the crimper, and the end portion of the electric wire 11 subjected to pretreatment is placed in the barrel portion 21.

In this state, the upper crimping die 42 is made closer to the lower crimping die 41, thereby inwardly-squeezing and crimping the barrel portion 21 of the connector terminal 10.

As mentioned above, when the barrel portion 21 is inwardly squeezed by means of the lower crimping die 41 and the upper crimping die 42 of the crimper, the separated portion 13*a* of the outer cover 13 displaced toward the end portion of the electric wire 11 is crimped to the forefront crimping portion 22; the exposed portion of the core wire 12 of the electric wire 11 is crimped to the core wire crimping portion 23; and the outer cover 13 of the electric wire 11 is crimped to the outer cover crimping portion 24. Thus, the connector terminal 10 is connected to the core wire 12 of the electric wire 11 in an electrically conductive manner.

As a result of the connector terminal 10 being crimped to the electric wire 11 as mentioned above, the exposed portion of the core wire 12 of the electric wire 11 is covered with the core wire crimping portion 23. Further, the separated portion 13*a* of the outer cover 13, which is a portion of the outer cover 13, crimped to the forefront crimping portion 22 is compressed, whereby a hole through which the core wire 12 is inserted is closed. The forefront portion of the core wire 12 is sealed by the separated portion 13 of the outer cover 13 compressed by the forefront crimping portion 22. Moreover, a rear side of the exposed portion of the core wire 12, which is opposite to the forefront side, is sealed as a result of the outer cover 13 being crimped to the outer cover crimping portion 24.

Specifically, according to the method for connection of the connector terminal of the embodiment, the separated portion 13*a* of the outer cover portion 13, which has been cut and separated in the neighborhood of the end portion, is displaced toward the end portion, thereby partially exposing the core wire 12. The separated portion 13*a* of the outer cover portion 13, the exposed portion of the core wire 12, and the portion of the electric wire covered with the outer cover 13 are crimped to the respective corresponding portions of the barrel portion 21 of the connector terminal 10, thereby completely sealing the exposed portion and its neighborhood of the core wire 12 of the electric wire 11 and rendering the core wire 12 waterproof. Consequently, even when dissimilar metals are connected to each other, occurrence of electrical corrosion, such as bimetallic corrosion, in a connection portion can be prevented without molding the connection portion in resin by means of the molding machine. Specifically, the connector terminal can be reliably connected to the electric wire 11, and a superior anticorrosion property can be yielded at the area where the connector terminal is connected to the core wire 12 while saving costs of facilities and manufacturing costs is achieved by obviating a necessity for the molding machine and the molding resin. Expanding wire harness to a manufacturing plant can be practiced with advantage.

Figure 7:
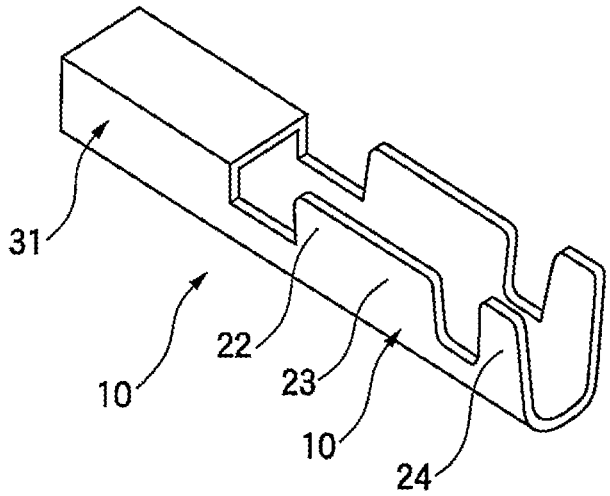
FIG. 7 is a perspective view of a connector terminal of an exemplary modification.

FIG. 7 is a perspective view of a connector terminal of an exemplary modification.

As shown in FIG. 7, the core wire crimping portion 23 and the outer cover crimping portion 24 that make up the barrel portion 21 are separated from each other in the connector terminal 10. When the connector terminal 10 is crimped to the end portion of the electric wire 11 by crimping the barrel portion 21, the separated core wire crimping portion 23 and the outer cover crimping portion 24 are independently crimped to the core wire 12 and the outer cover 13 that differ from each other in terms of an outer diameter. The connector terminal 10 can be connected to the end portion of the electric wire 11 more thoroughly.

The present invention is not limited to the embodiment and is susceptible to alterations, modifications, and others, as necessary. In addition, a material, a shape, a dimension, the number, a location, and the like, of each of the constituent elements in the embodiment are arbitrary and unlimited, so long as the present invention can be accomplished.

The present invention makes it possible to provide a structure and method for connection of a connector terminal that can be connected to an electric wire without fail and exhibit a superior anticorrosion property at a connection portion where the connector terminal is connected to a conductor while saving costs of facilities and manufacturing costs is achieved.

What is claimed is:

1. A structure for connection, comprising:

an electric wire whose conductor is covered with an outer cover; and a connector terminal connected to the electric wire;

wherein the connector terminal has a barrel portion for crimping an end portion of the electric wire and an electric connection portion to be electrically connected to a mating terminal;

wherein the outer cover is cut and separated in a vicinity of the end portion of the electric wire, and a separated portion of the outer cover is displaced toward the end portion so as to expose the conductor; and the separated portion of the outer cover displaced toward the end portion of the electric wire, an exposed portion of the conductor, and a portion of the electric wire covered with the outer cover are crimped to the barrel portion of the connector terminal in a state that the exposed portion and its neighborhood of the conductor are completely sealed.

2. A method for connecting a connector terminal to an electric wire, in which the connector terminal has a barrel portion for crimping an end portion of the electric wire whose conductor is covered with an outer cover and an electric connection portion electrically connected to a mating terminal, the method comprising:

cutting and separating the outer cover in a vicinity of the end portion of the electric wire;

displacing a separated portion of the outer cover toward the end portion so as to expose the conductor; and crimping the separated portion of the outer cover displaced toward the end portion of the electric wire, an exposed portion of the conductor, and a portion of the electric wire covered with the outer cover to the barrel portion of the connector terminal in a state that the exposed portion and its neighborhood of the conductor are completely sealed.

* * * * *